United States Patent [19]

Koshizuka et al.

[11] Patent Number: 4,623,580

[45] Date of Patent: Nov. 18, 1986

[54] THERMAL TRANSFER RECORDING MEDIUM

[75] Inventors: Kunihiro Koshizuka, Hino; Takao Abe, Tokyo; Shigehiro Kitamura; Masaki Nakamura, both of Hachioji; Yuji Hotta, Hachioji; Fumio Ishii, Akishima, all of Japan

[73] Assignee: Konishiroku Photo Industry Co., Ltd., Tokyo, Japan

[21] Appl. No.: 665,789

[22] Filed: Oct. 29, 1984

[30] Foreign Application Priority Data

Nov. 2, 1983 [JP] Japan ..... 58-204708

[51] Int. Cl.[4] ..... B41M 5/26

[52] U.S. Cl. ..... 428/216; 346/204; 428/195; 428/207; 428/209; 428/211; 428/484; 428/488.1; 428/488.4; 428/913; 428/914

[58] Field of Search ..... 346/200, 204, 226; 428/195, 203, 204, 207, 484, 488.1, 488.4, 913, 914, 209, 211–213, 216

[56] References Cited

U.S. PATENT DOCUMENTS 4,500,896 2/1985 Kubo et al. ..... 428/488.4

FOREIGN PATENT DOCUMENTS 0182492 11/1982 Japan ..... 428/195
0217392 12/1983 Japan ..... 428/488.1
0064389 4/1984 Japan ..... 428/914
0073995 4/1984 Japan ..... 428/913

*Primary Examiner*—Bruce H. Hess
*Attorney, Agent, or Firm*—Frishauf, Holtz, Goodman & Woodward

[57] ABSTRACT

A thermal transfer recording medium having a thermally transferable coloring agent containing layer coated on a support. The coloring agent containing layer is separated into at least two layers, one of which is the upper layer and the other of which is the lower layer, and the layer farthermost from the support is a thermally transferable layer containing substantially no coloring agent.

20 Claims, No Drawings

THERMAL TRANSFER RECORDING MEDIUM

BACKGROUND OF THE INVENTION

1. Field of the Invention

This invention relates to a thermal transfer recording medium and more particularly to a thermal transfer recording medium capable of obtaining an excellent color dye transfer image without lowering the resolving power of the image even when using a sheet of plain paper of a low surface smoothness.

2. Description of the Prior Art

A thermal transfer recording medium has so far been used as a recording medium through which an image is transferred to and formed on such a recording sheet as a sheet of plain paper by the use of a thermal printer, a thermal facsimile apparatus or the like. It has been well known that such a thermal transfer recording medium as mentioned above has at least one coloring agent containing layer on the support of the recording medium and that such a coloring agent containing layer includes, for example, a layer containing a coloring agent comprising such a dye as a pigment and a thermally fusible material, and the like. And, as for such a support as mentioned above, there have been used a variety of films excellent in surface smoothness and in dimensional stability so as to obtain an excellent reproducibility in a dye transfer image produced of a coloring agent containing layer coated on the support.

A dye transfer image, i.e., a printed image, obtained through such a conventional thermal transfer recording medium as mentioned above has been disadvantageous because when a sheet of plain paper has been used as a recording sheet, the transferred image has not been clear and sharp unless the surface of the plain paper has been very smooth. As far as this disadvantage is concerned, it may be solved because a relatively sharp dye transfer image may also be reproduced on a sheet of not so smooth paper if a large quantity of thermally fusible materials, coloring agents and the like is added in a coloring agent containing layer. However, the coloring agent containing layer must be thickened as much as they were added, and the resolving power is accordingly lowered. Besides, a fog is caused. The alternatives have been the disadvantage first described and these ones.

OBJECTS OF THE INVENTION

It is an object of the invention to provide a thermal transfer recording medium which does not lower the resolving power thereof when an image is thermally transferred, and resultantly provides a clear and sharp dye transfer image even when using a sheet of plain paper having a low surface smoothness.

Another object of the invention is to provide a thermal transfer recording medium capable of inhibiting a fog which maybe caused thereon.

Other and further objects of the invention will appear more fully from the following description.

SUMMARY OF THE INVENTION

After the inventors devoted themselves to study, they found that the above-mentioned objects of the invention can be accomplished by a thermal transfer recording medium having a support bearing thereon a thermally transferable coloring agent containing layer, wherein the coloring agent containing layer is separated into at least two layers, one of which is the upper layer and the other of which is the lower layer, and the contents of a coloring agent in the layer farthermost from the support are from 0 to 30% by weight of the whole quantity of the coloring agents in the whole coloring agent containing layer.

DETAILED DESCRIPTION OF THE INVENTION

The invention will become more apparent in the detailed description and examples which follow.

A thermal transfer recording medium of the invention has a support bearing at least a thermally transferable coloring agent containing layer thereon. The coloring agent containing layer is separated into at least two layers, one of which is the upper layer and the other of which is the lower layer. Out of them, the thermally transferable coloring agent containing layers closer to the support (i.e., the other coloring agent containing layers than that farthermost from the support) are thermally fusible coloring agent containing layers each containing coloring agents. The coloring agent containing layer farthermost from the support is a thermally transferable layer containing the coloring agent in the range of from 0% to 30% by weight of the whole coloring agent.

In this invention, the whole coloring agent containing layer shall be called the "coloring agent containing layer", and the coloring agent containing layers other than that farthermost from the support shall be called the "lower coloring agent containing layers". Further, the layer farthermost from the support shall be called the "thermally transferable layer".

The composition of the lower coloring agent containing layers of the invention may be selected, without any specific limitation, from those of the known thermally fusible coloring agent containing layers i.e., the ink layers.

The composition of a lower coloring agent containing layer of the invention is, for example, to contain one or more kinds each of coloring agents and thermally fusible materials.

For the coloring agents of the invention, a variety of dyes and pigments being popularly used by those skilled in the art may also be used without any specific limitation. For example, they include the materials having their own color and being in the solid or semisolid state at room temperature and further being capable of dissolving or dispersing in the binders of a coloring agent containing layer when fusing. A variety of dyes well-known by those skilled in the art may be used for the coloring agents of the invention.

The dyes of the invention may be selected from those such as direct dyes, acid dyes, basic dyes, disperse dyes, oil-soluble dyes and the like. To be concrete, the suitably usable yellow dyes include, for example, Kayalon Polyester Light Yellow 5G-S (mfd. by Nippon Kayaku Co., Ltd., Japan), Oil Yellow S-7 (mfd. by Hakudo Co., Japan), Aisen Spilon Yellow GRH Special (mfd. by Hodogaya Chemical Co., Japan), Sumi Plast Yellow FG (mfd. by Sumitomo Chemical Co., Japan), Aisen Spilon Yellow GRH (mfd. by Hodogaya Chemical Ind. Co., Ltd., Japan), and the like; the suitably usable red dyes include, for example, Diacelliton Fast Red R (mfd. by Mitsubishi Chemical Co., Japan), Dianix Brilliant BS-E (mfd. by Mitsubishi Chemical Co., Japan), Sumi Plast Red FB (mfd. by Sumitomo Chemical Co., Japan), Sumi Plast Red HFG (mfd. by Sumitomo Chemical Co., Japan), Kayalon Polyester Pink RCL-E (mfd. by Nippon Kayaku Co., Ltd., Japan), Aisen Spilon Red GEH Special (mfd. by Hodogaya Chemical Co., Japan), and the like; and the suitably usable blue dyes include, for example, Diacelliton Fast Brilliant Blue R (mfd. by Mitsubishi Chemical Co., Japan), Dianix Blue EB-E (mfd. by Mitsubishi Chemical Co., Japan), Kayalon Polyester Blue B-SF Conc. (mfd. by Nippon Kayaku Co., Japan), Sumi Plast Blue 3R (mfd. by Sumitomo Chemical Co., Japan), Sumi Plast Blue G (mfd. by Sumitomo Chemical Co., Japan) and the like, the suitably usable yellow pigments include, for example, Hansa Yellow 3G, Tartrazine Lake and the like; the suitably usable red pigments include, for example, Brilliant Carmine FB-Pure (mfd. by Sanyo Dye Co., Japan), Brilliant Carmine 6B (mfd. by Sanyo Dye Co., Japan), Alizarine Lake, and the like; the suitably usable blue pigments include, for example, Cerulean Blue, Sumika Print Cyanine Blue GN-O (mfd. by Sumitomo Chemical Co., Japan), Phthalocyanine Blue, and the like; and the suitably usable black pigments include, for example, carbon black, oil black and the like. Besides the above, a metal particle and a metal oxide may also be used for the pigments of the invention. In this invention, carbon black is preferable to use.

The lower coloring agent containing layers of the invention contain one or more kinds of thermally fusible materials. For these thermally fusible materials, those well-known in the art may be used without any specific limitation.

The thermally fusible materials preferably usable in the invention are those having a softening point (measured in a ring and ball method) and a melting point (measured with a Yanagimoto MPJ-2 model) of not higher than 120° C. and particularly those having a melting point of from 40° C. to 20° C.

The examples of thermally fusible materials preferably usable in the invention include, to be more concrete, vegetable wax such as carnauba wax, Japan wax, ouricury wax, esparts wax and the like; animal wax such as bees wax, insect wax, shellac wax, spermaceti wax and the like; petroleum wax such as paraffin wax, microcrystalline wax, ester wax, oxidized wax and the like; mineral wax such as montan wax, azocerite, caresine and the like; a higher fatty acid such as palmitic acid, stearic acid, margaric acid, beheic acid and the like; a higher alcohol such as palmityl alcohol, stearyl alcohol, behenyl alcohol, margaryl alcohol, myricyl alcohol, eicosanol and the like; a higher fatty acid ester such as cetyl palmitate, myricyl palmitate, cetyl stearate, myricyl stearate and the like; an amide such as acetamide, propionic acid amide, palmitic acid amide, stearic acid amide, amide wax and the like; a rosin derivative such as ester gum, rosin maleic acid resin, rosin phenol resin, hydrogenated rosin and the like; a macromolecular compound having a softening point of from 40° C. to 120° C. such as phenol resin, terpene resin, cyclopentadiene resin, an aromatic resin and the like; a higher amine such as stearylamine, behenylamine, palmitinamine and the like; a polyethylene oxide such as polethylene glycol 4000, polyethylene glycol 6000 and the like. These may be used independently or in combination. And, inter alia, higher amides such as palmitic acid amide, stearic acid amide, oleic acid amide, amide wax and the like are particularly preferred to use.

It is preferred that each lower coloring agent containing layer of the invention shall be composed of a thermally fusible material of 50% to 90% by weight and a coloring agent of 10 to 50% by weight (hereinafter called simply %).

In a thermal transfer recording medium of the invention, the uppermost coloring agent containing layer, that is a thermally transferable layer, does not substantially contain coloring agents. The expression "not substantially contain" as used herein means that the contents of a coloring agent in such a thermally transferable layer are not more than 30% and preferably not more than 10% and more preferably 0 to 5%, provided that the whole contents of the coloring agents in the whole of the coloring agent containing layers are regarded to as 100%. If the contents of such coloring agents in a thermally transferable layer of the invention should exceed 30% of the whole contents thereof in the whole coloring agent containing layers, the improvable effect of the resolving power of the recording medium will be small, and it becomes difficult to inhibit stains from occurring.

A thermally transferable layer of the invention is a layer containing one or not less than two kinds of thermally fusible materials. The thermally fusible materials usable in the invention may be either the same as or the different from those given in the description of the aforementioned lower coloring agent containing layers.

It is preferred that a thermally transferable layer, that is the upper coloring agent containing layer, shall be composed of a thermally fusible material and a coloring agent in the proportion of the former of from 90 to 100% and the latter of from 0 to 10%, provided that the contents of the coloring agents shall not exceed 30% of the whole coloring agents in the whole coloring agent containing layers, as described above.

A coloring agent containing layer of the invention comprises, as mentioned above, the thermally transferable layer and the lower coloring agent containing layers, and the composite proportion of the whole coloring agent containing layers may be equivalent to those of well-known coloring agent containing layers. The dry thickness of such coloring agent containing layer to be used in the invention may be those of the well-known coloring agent containing layers, which are, for example, not thicker than 20$\mu$, and more preferably not thicker than 10$\mu$ and particularly not thicker than 7$\mu$. It is better to provide the thickness of a thermally transferable layer of the invention among those coloring agent containing layers so as to be 10% to 80% in the total thickness of the whole coloring agent containing layers and more preferably 20% to 60%.

The coloring agent containing layers of the invention may also contain, besides the above-mentioned components, a variety of additives. For example, such additives include heat conductivity materials having a high heat-conductivity such as aluminium, copper, zinc and the like. These heat-conductive materials will promote a heat-conductive effects that a coloring agent containing layer may be fused, softened or sublimated. As a softening agent, a vegetable oil such as castor oil, linseed oil and olive oil, an animal oil such as whale oil, and a mineral oil may suitably be used.

There are the coating methods having been well-known in the art which are suitable for coating a coloring agent layer on a support in a solvent coating process or a hot melt coating process. These techniques may be applied to this invention. For example, a coloring agent containing layer can be coated in such a method that a coating liquid of the invention is solvent-coated on by using a well-known and arbitrary technique such as a reverse-roll coating, an extrusion coating, a gravure coating, a wire-bar coating technique and the solvents are then removed. It is preferred to prepare a coloring agent containing layer of the invention in a single layer coating process, however, it is also allowed to take a simultaneous multi-layer coating process.

A thermal transfer recording medium of the invention has at least a coloring agent containing layer of the invention, and besides the above, it may also have the other component layers such as a subbing layer and the like. The subbing layers include, for example, those made of silicone resin, melamin resin, polyvinylacetal resin, polyethylene, polyvinyl chloride, polyvinylidene chloride, fluororesin or the like. The above-mentioned subbing layer may be coated in advance of coating the coloring agent containing layers.

A thermal transfer recording medium of the invention may also be constructed in such a manner that the support thereof is coated with a non-transferable coloring agent carrying layer containing a thermal migratory coloring agent and a coloring agent containing layer of the invention is coated thereon.

The supports serving as the substrates of the thermal transfer recording media of the invention are desirably high in heat resistance, dimensional stability and surface smoothness. The heat resistance thereof must keep both of the strength and dimensional stability of such supports so as not to be softened and plasticized by the heat from a heat source such as a thermal head. The surface smoothness thereof is desired to satisfactorily display an excellent transferability of a thermally fusible material containing layer on the support. In a smoothness test (JIS P 8119) with a Bekk tester, a satisfactory smoothness is not less than 100 sec., and when it is not less than 300 sec., a reproducible image can be obtained with a more excellent transferability. The materials suitably useful for such supports include, for example, a sheet of paper such as a plain paper, condenser paper, laminated paper, coated paper and the like; a resin film such as those of polyester, polycarbonate, polyethylene, polystyrene, polypropylene, polyimido, and the like; a paper-resin film complex; a metal sheet such as an alminium foil; and the like. The thickness of such is, normally, not thicker than about 60μ from the viewpoint of obtaining an excellent heat-conductivity and preferably 2μ, to 20μ. In addition, the back side of the support of a thermal transfer recording medium of the invention may arbitrarily be constructed.

Heretofore, thermal transfer recording media having the so-called multilayered coloring agent containing layers have been well-known as described in Japanese Patent Publication Open to Public Inspection Nos. 36698/1982 and 138984/1982. The object of the above-mentioned conventional multilayered coloring agent containing layers has been to provide multiple recording or printing, and not only the object thereof has been different from that of the invention but also their technical constitution has been quite different from that of the invention. In such conventional thermal transfer recording media, it has been known that a surface layer may be formed on a coloring agent containing layer. As it is obvious from the fact that such surface layer is called a protective layer or an overcoating layer, the surface layer functions to protect the coloring agent containing layers. Therefore, the above-mentioned conventional thermal transfer recording media are quite different from those of the invention in technical idea. In this invention, a surface layer may also be arranged, with the above-mentioned purpose, onto a thermally transferably layer.

EFFECTS OF THE INVENTION

In the thermal transfer recording media of the invention having a thermally transferble coloring agent containing layer coated on the support thereof, each of them is constituted in that the coloring agent containing layer is separated into at least two layers, one of which is the upper layer and the other of which is the lower layer, and the layer farthermost from the support is a thermally transferable layer not substantially containing a coloring agent. It is therefore possible to display such effects that an excellent dye transfer image is obtained without lowering the resolving power even when using a sheet of plain paper low in surface smoothness such as a sheet of pulp paper. Thus, the objects of the invention first stated can be achieved and further stains can be prevented from occurring which previously had been unavoidable in the described conventional thermal transfer recording media.

EXAMPLE

To further illustrate this invention, and not by way of limitation, the following examples are given. Unless otherwise stated, the word, "part(s)" are expressed as "part(s) by weight".

EXAMPLE 1

Coating liquid (1) (at 70° C.) was prepared by dissolving 9 parts of Paraffin Solid 32030 (mfd. by Kanto Chemical Co., Japan), 9 parts of Ester Wax (mfd. by Hoechst, W. Germany) and 2 parts of a low molecular weight polyethylene into 20 parts of 10% carbon black dispersed toluene. This coating liquid (1) was coated on a polyethylene terephthalate film support of 5.2μ in thickness by making use of a gravure coater and was then dried. Thus, Sample (1) (for comparison) of a thermal transfer recording medium having a coloring agent containing layer of 6μ in thickness was obtained.

On the other hand, Sample (2) (for comparison) of another thermal transfer recording medium was obtained in the same manner as taken in Sample (1), except that the carbon black dispersion liquid was used in place of 20 parts of a 20% toluen dispersion liquid and the dry thickness of the coloring agent containing layer was changed into 3μ instead of 6μ.

Next, there was prepared Sample (3) (of this invention) of a further thermal transfer recording medium having a thermally transferable layer of 3μ in dry thickness in such a manner that the above-mentioned Sample (2) was used and the coloring agent containing layer thereof was arranged to serve as a lower coloring agent containing layer and was then coated thereon with the following composed coating liquid for the use of thermally transferable layers.

Coating Liquid for the Use of Thermally Transferable Layers

| | |
|---|---|
| Paraffin Solid 32030 | 9 parts |
| Hoechst E | 9 parts |
| Low molecular weight polyethylene (molecular wt: 400) | 2 parts |
| When the above coating liquid was coated on, a heptane solution (solid:Liquid = 2:5) was prepared to use. | |

With Samples (1), (2) and (3), respectively, an image was tried to record on a sheet of plain paper by means of a highly sensitive thermal printer (a trial printer equipped with a thin film type line thermal head of 8 dot/mm in heating element density), and the resolving power, grey background (fog) and transferability were measured in the following methods: (Resolving power)

A checkered pattern was printed on a sheet of plain paper of 550 sec in Bekk smoothness and the printed pattern was observed by means of a magnifier. The results were that Samples (2) and (3) each displayed the checkered pattern, while Sample (1) displayed a filled-in pattern.

(Grey Background -Fog-)

Various Chinese characters were printed on a sheet of plain paper of 28 sec in Bekk smoothness, and the stain on the other portions than the printed portions were observed by a magnifier. The results were that Samples (1) and (2) showed some stains between the characters, while Sample (3) showed no stain at all.

(Transferability)

The over-all transfer was made on a sheet of plain paper of 28 sec in Bekk smoothness, and the untransferred areas were observed by a magnifier. The results were that Samples (1) and (3) produced almost no untransferred areas, while Sample (2) (for comparison) had many.

What is claimed is:

1. A thermal transfer recording medium comprising a support and a plurality of thermal-transferable layers containing a thermal-fusible material, said layers, as a whole, containing a coloring agent and 0 to 30% by weight of the whole coloring agent being present in the furthest layer thereof from said support.

2. The thermal transfer recording medium of claim 2, wherein said coloring agent is selected from the group consisting of direct dyes, acid dyes, basic dyes, disperse dyes, oil-soluble dyes and pigment.

3. The thermal transfer recording medium of claim 1, wherein the total thickness of said coloring agent containing layer is less than 20 μm.

4. The thermal transfer recording medium of claim 3, wherein the thickness of said furthest layer is in the range of from 10% to 80% of whole thickness of said coloring agent containing layer.

5. The thermal transfer recording medium of claim 4, wherein the thickness of said furthest layer is in the range of from 20% to 60% of whole thickness of said coloring agent containing layer.

6. The thermal transfer recording medium of claim 1, wherein said thermal transfer recording medium further comprises a subbing layer.

7. The thermal transfer recording medium of claim 1, wherein said coloring agent containing layer contains a thermal conductive material.

8. The thermal transfer recording medium of claim 1, wherein said support has a thickness in the range of from 2 μm to 20 μm.

9. The thermal transfer recording medium of claim 1, wherein said support is composed of a material selected from the group consisting of papers, resin films, paper resin film complexes, and metal sheets.

10. The thermal transfer recording medium of claim 1, wherein 0 to 10% by weight of the whole coloring agent is present in said furthest layer.

11. The thermal transfer recording medium of claim 10, wherein 0 to 5% by weight of the whole coloring agent is present in said furthest layer.

12. The thermal transfer recording medium of claim 11, wherein said thermal fusible material has a softing point or a melting point less than 120° C.

13. The thermal transfer recording medium of claim 12, wherein the total thickness of said coloring agent containing layer is less than 20 μm, and the thickness of said furthest layer is in the range of from 10% to 80% of whole thickness of said coloring agent containing layer.

14. The thermal transfer recording medium of claim 13, wherein said support has a thickness in the range of from 2 μm to 20 μm, and the thickness of said furthest layer is in the range of from 20% to 60% of whole thickness of said coloring agent containing layer.

15. The thermal transfer recording medium of claim 14, wherein said coloring agent is selected from the group consisting of direct dyes, acid dyes, basic dyes, disperse dyes, oil-soluble dyes and pigment, said thermal transfer recording medium further comprises a subbing layer, said coloring agent containing layer contains a thermal conductive material, and said support is composed of a material selected from the group consisting of papers, resin films, paper resin film complexes, and metal sheets.

16. The thermal transfer recording medium of claim 15, wherein 0 to 5% by weight of the whole coloring agent is present in said furthest layer.

17. The thermal transfer recording medium of claim 14, wherein 0 to 10% by weight of the whole coloring agent is present in said furthest layer.

18. The thermal transfer recording medium of claim 10, wherein said support has a thickness in the range of from 2 μm to 20 μm, and the thickness of said furthest layer is in the range of from 20% to 60% of whole thickness of said coloring agent containing layer.

19. The thermal transfer recording medium of claim 18, wherein the total thickness of said coloring agent containing layer is less than 20 μm, and the thickness of said furthest layer is in the range of from 10% to 80% of whole thickness of said coloring agent containing layer.

20. The thermal transfer recording medium of claim 18, wherein 0 to 5% by weight of the whole coloring agent is present in said furthest layer.

* * * * *